US010560985B2

(12) United States Patent
Cha

(10) Patent No.: US 10,560,985 B2
(45) Date of Patent: Feb. 11, 2020

(54) INDUCTION HEAT COOKING APPARATUS

(71) Applicant: LG ELECTRONICS INC., Seoul (KR)

(72) Inventor: Jungmin Cha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 324 days.

(21) Appl. No.: 15/602,404

(22) Filed: May 23, 2017

(65) Prior Publication Data

US 2017/0347406 A1 Nov. 30, 2017

(30) Foreign Application Priority Data

May 27, 2016 (KR) ..... 10-2016-0065406

(51) Int. Cl.
*H05B 6/12* (2006.01)
*H05B 6/04* (2006.01)
*H05B 6/10* (2006.01)

(52) U.S. Cl.
CPC ..... *H05B 6/1263* (2013.01); *H05B 6/1209* (2013.01)

(58) Field of Classification Search
CPC ..... H05B 6/1263; H05B 6/1209
USPC ..... 219/620–624, 626, 627, 632, 647, 660, 219/661, 662, 664; 327/427
See application file for complete search history.

(56) References Cited

U.S. PATENT DOCUMENTS

2012/0097664 A1* 4/2012 Kataoka ..... H05B 6/1263 219/632
2014/0151365 A1* 6/2014 Oh ..... H05B 6/065 219/620

FOREIGN PATENT DOCUMENTS

| | | |
|---|---|---|
| JP | 2004-087305 | 3/2004 |
| JP | 2011-253805 | 12/2011 |
| KR | 10-2006-0081554 | 7/2006 |

OTHER PUBLICATIONS

Translation of JP2011253805A, Induction heating cooking device, Published Dec. 15, 2011, (Year: 2011).*
Translation of JP2004087305A, Induction heating cooker, Published Mar. 18, 2004. (Year: 2004).*
Korean Office Action dated Nov. 16, 2017.

* cited by examiner

*Primary Examiner* — Quang T Van
(74) *Attorney, Agent, or Firm* — KED & Associates LLP

(57) ABSTRACT

An induction heat cooking apparatus is provided that may include heating coils, a plurality of heating elements that operates the heating coils, a housing that accommodates the plurality of heating elements, a cooling fan that blows air that cools the plurality of heating elements accommodated in the housing, a first cooling flow channel in which a first group of heating elements of the plurality of heating elements is positioned, a second cooling flow channel in which a second group of heating elements of the plurality of heating elements having exothermic values lower than exothermic values of the first group of heating elements is positioned, and a flow guide that divides the first cooling flow channel from the second cooling flow channel and guides a flow of the air blown by the cooling fan to allow the air to flow to the first cooling flow channel first and then flow to the second cooling flow channel.

13 Claims, 8 Drawing Sheets

INDUCTION HEAT COOKING APPARATUS

CROSS-REFERENCE TO RELATED APPLICATION(S)

This application claims priority to and the benefit of Korean Patent Application No. 10-2016-0065406, filed in Korea on May 27, 2016, the disclosure of which is incorporated herein by reference in its entirety.

BACKGROUND

1. Field

An induction heat cooking apparatus is disclosed herein.

2. Background

Generally, an induction heat cooking apparatus is an electric cooking apparatus that performs a cooking function by applying a high frequency current to a working coil or a heating coil to allow an eddy current to flow to directly heat a cooking container while a strong magnetic force line generated by the high frequency current passes through the container. In a basic heating principle of an induction heat cooking apparatus, as a current is applied to a heating coil, a cooking container which is made of a magnetic substance generates heat due to induction heating, and the cooking container is heated by the generated heat as described above to cook items disposed therein.

An inverter used for an induction heating apparatus switches a voltage applied to a heating coil to allow a high frequency current to flow through the heating coil. The inverter is configured to drive a switching element formed of an insulated gate bipolar transistor (IGBT) to allow the high frequency current to flow through the heating coil to form a high frequency magnetic field at the heating coil.

Korean Patent Publication No. 10-2006-0081554, which is a prior art document and which is hereby incorporated by reference, discloses an induction heater of an electric range. In a case of the induction heater of an electric range disclosed in the prior art document, a portion of air blown from an exothermic fan is provided to an exothermic portion and a coupling portion of a heat sink, and another portion thereof faces an inside of a circuit board to dissipate heat of not only a portion of the circuit board which is coupled with the coupling portion of the heat sink but also other circuit components provided at other portions of the circuit board. However, according to the prior art document, as the air blown by the exothermic fan is divided and flows, a cooling performance of the exothermic portion of the heat sink, which has a highest exothermic temperature, deteriorates, and especially further deteriorates as an output of the heater increases.

BRIEF DESCRIPTION OF THE DRAWINGS

Embodiments will be described in detail with reference to the following drawings in which like reference numerals refer to like elements, and wherein.

DETAILED DESCRIPTION

Figure 1:
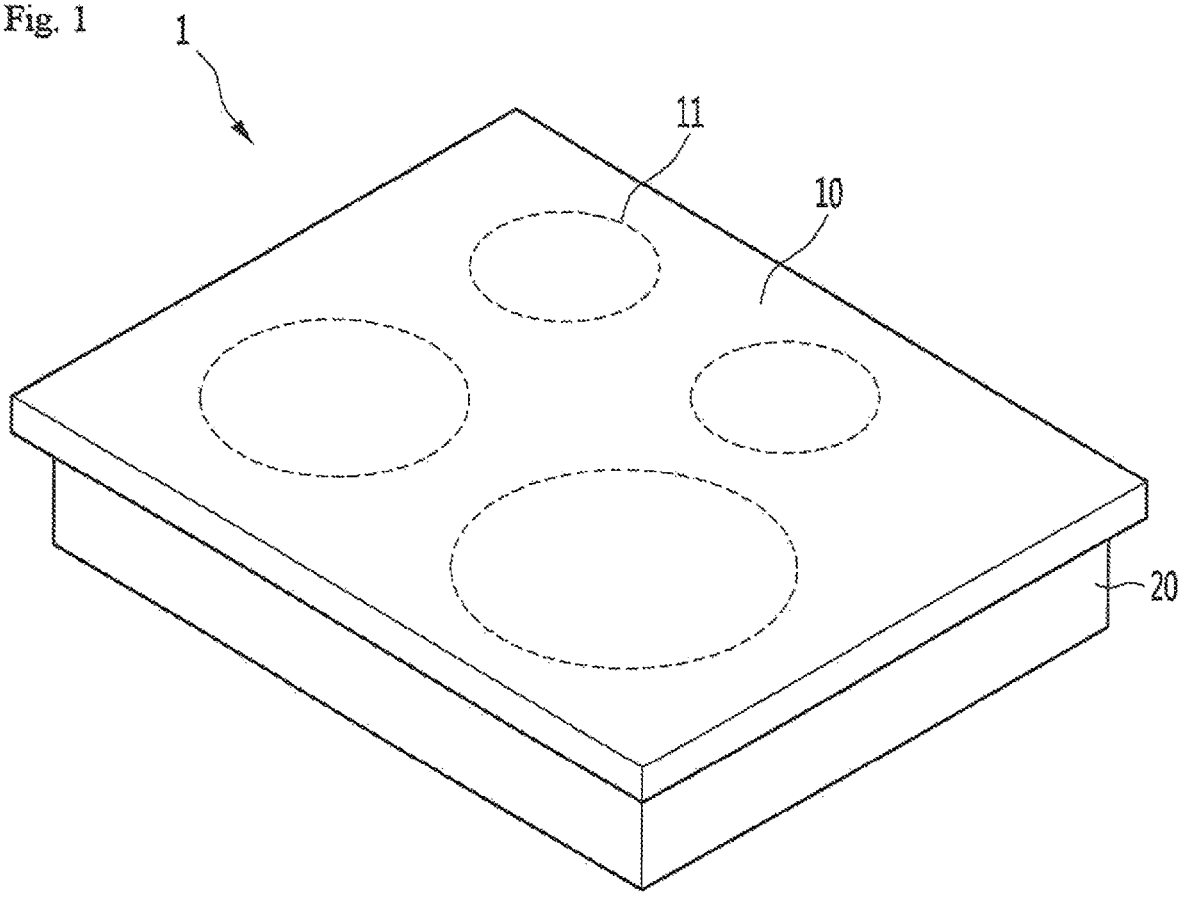
FIG. 1 is a perspective view of an induction heat cooking apparatus according to an embodiment.

Hereinafter, embodiments will be described in detail with reference to the drawings. Like or similar reference numerals should be understood as referring to like or similar elements even when shown in different drawings. Also, when it is determined that a detailed description of a well-known related configuration or function obscures the understanding of the embodiments, the detailed description thereof will be omitted.

Also, components of the embodiments will be referred to using terms such as first, second, A, B, (a), (b), for example. The above-described terms are merely used for distinguishing one component from another, and the essentials of the corresponding component, order, sequence, for example, are not limited by the terms. When one component is described as being "linked," "coupled," or "connected," to another component, it should be understood that the one component may be directly linked, coupled, or connected to the other component or another component may be "linked," "coupled," or "connected" therebetween.

Figure 2:
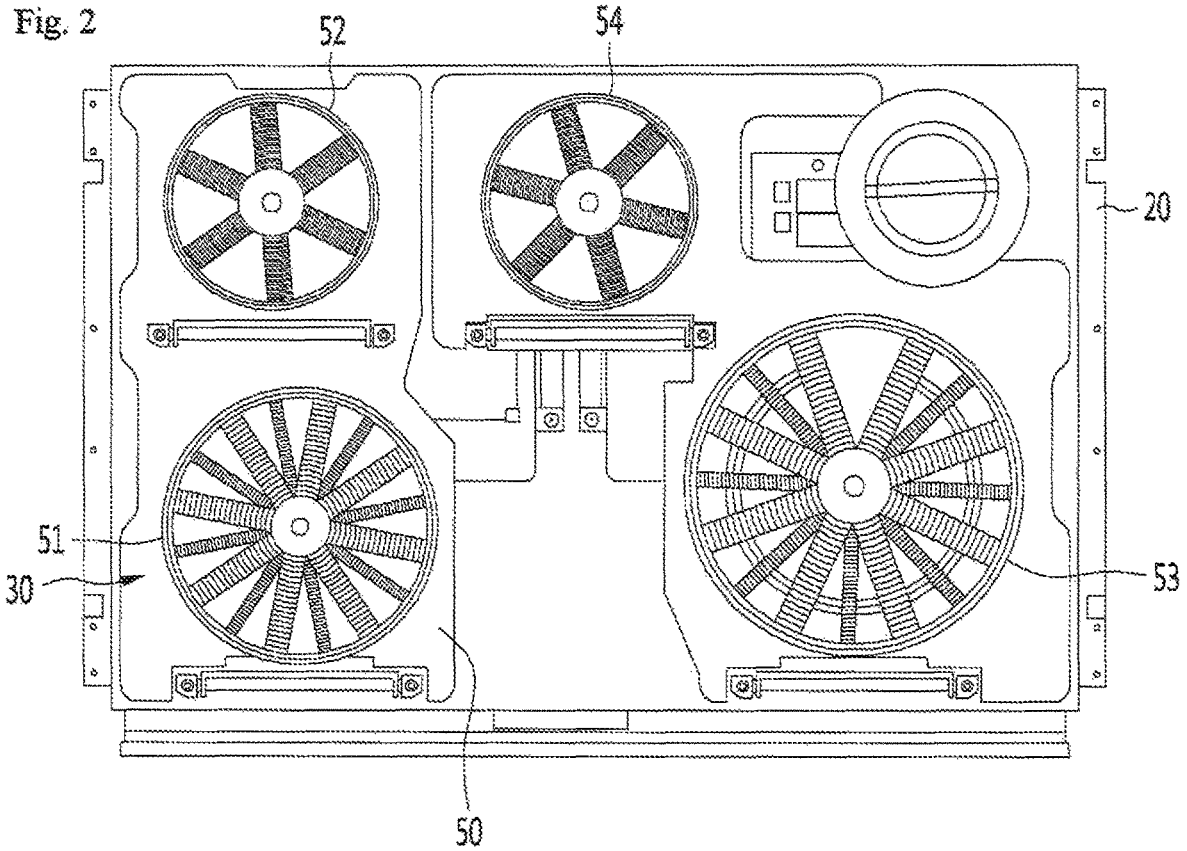
FIG. 2 is a view illustrating an internal configuration of the induction heat cooking apparatus according to an embodiment.
Figure 3:
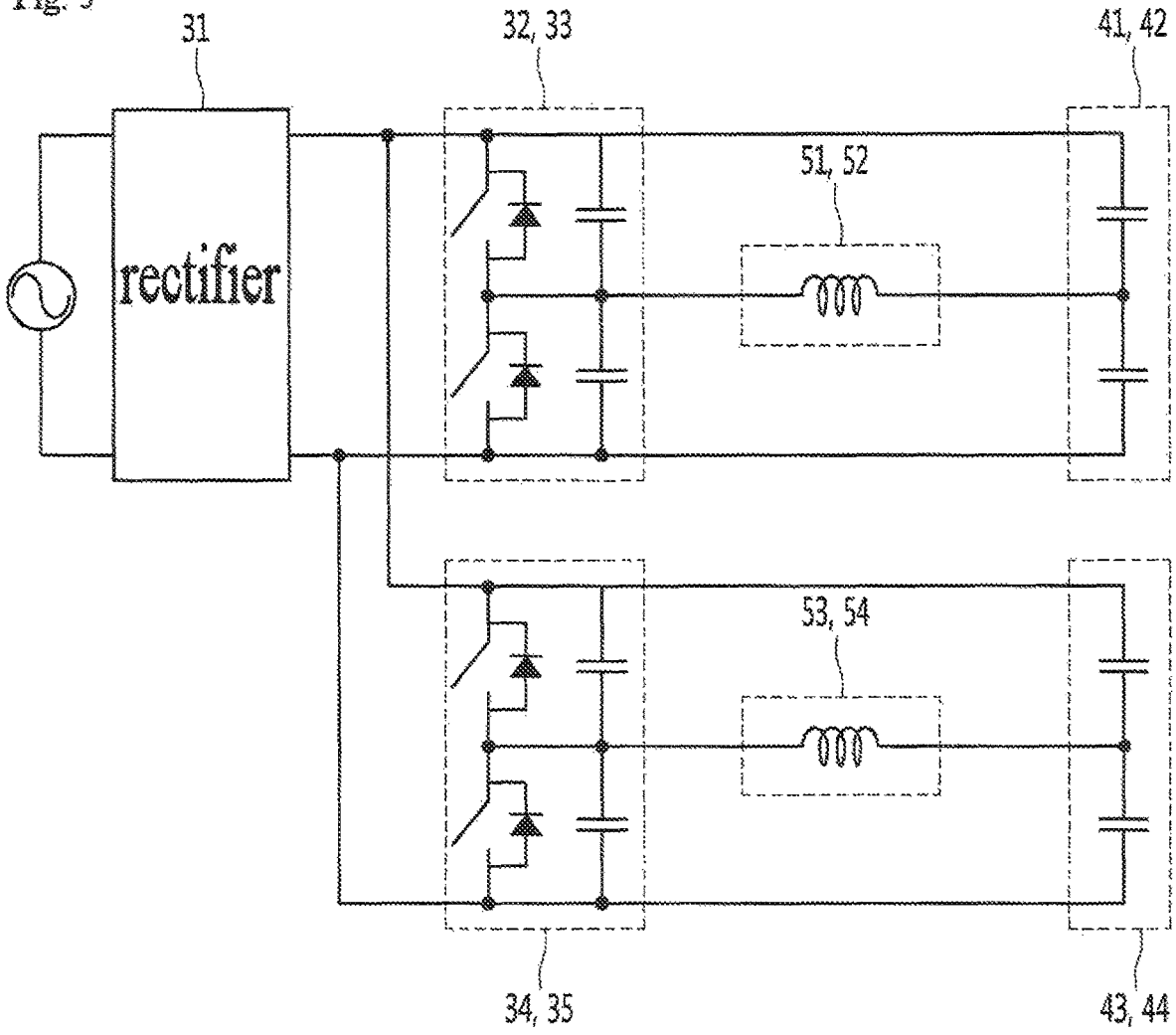
FIG. 3 is a schematic circuit diagram of the induction heat cooking apparatus according to an embodiment.

FIG. 1 is a perspective view of an induction heat cooking apparatus according to an embodiment. FIG. 2 is a view illustrating an internal configuration of the induction heat cooking apparatus according to an embodiment. FIG. 3 is a schematic circuit diagram of the induction heat cooking apparatus according to an embodiment.

Referring to FIGS. 1 to 3, an induction heat cooking apparatus 1 according to an embodiment may include a top plate 10 that supports food or other items or a container filled with food or other items and a casing 20 that supports the top plate 10. The top plate 10 may include markings 11 that indicates a mounting position of the food or the container.

The induction heat cooking apparatus 1 may include an induction heater 30. The induction heater 30 may include a plurality of heating coils 51, 52, 53, and 54 capable of independently operating. Two or more of the plurality of heating coils 51, 52, 53, and 54 may interwork to operate.

The induction heater 30 may further include a rectifier 31, inverters 32, 33, 34, and 35, and resonance capacitors 41, 42, 43, and 44. The rectifier 31 may receive commercial alternating current (AC) power from the outside, and may rectify the AC power into direct current (DC) power.

The inverters 32, 33, 34, and 35 may include two switching elements that switch input power and are connected in series, and the plurality of heating coils 51, 52, 53, and 54 may be driven by output voltages of the switching elements. Also, the plurality of heating coils 51, 52, 53, and 54 may be connected to the resonance capacitors 41, 42, 43, and 44. In this embodiment, the induction heater 30 has been shown and described as including four heating coils 51, 52, 53, and 54; however, embodiments are not limited thereto.

Each of the plurality of heating coils 51, 52, 53, and 54 may be connected to the inverters 32, 33, 34, and 35 forming the two switching elements and the resonance capacitors 41, 42, 43, and 44 forming two capacitors. In this embodiment, two inverters 32 and 33, two heating coils 51 and 52, and two resonance capacitors 41 and 42 may form one or a first group and the other two inverters 34 and 35, the other two heating coils 53 and 54, and the other two resonance capacitors 43 and 44 may form another or a second group.

Driving of the switching elements may be performed by a controller (not shown). The switching elements may apply high frequency voltages to the heating coils 51, 52, 53, and 54 while reciprocally operating by being controlled by the controller. Also, as on/off times of the switching elements applied by a driver may be controlled to be gradually compensated for, voltages supplied to the plurality of heating coils 51, 52, 53, and 54 may be converted from low voltages into high voltages.

In this embodiment, the rectifier 31, the inverters 32, 33, 34, and 35, and the resonance capacitors 41, 42, 43, and 44 which form the induction heater 30 are heating elements that generate heat when the induction heater 30 operates. In this embodiment, the heating elements are elements which are operated to apply currents to the plurality of heating coils 51, 52, 53, and 54. The heating elements may be installed or provided in a housing 70 (refer to FIG. 4), which will be described hereinafter, and the heating coils 51, 52, 53, and 54 may be installed or provided at an additional coil installation 50.

Among the heating elements, the rectifier 31 and the inverters 32, 33, 34, and 35 are heating elements 61 which have a relatively higher exothermic values (hereinafter, referred to as a "first group of heating elements") and the resonance capacitors 41, 42, 43, and 44 are heating elements 62 which have a relatively low exothermic values (hereinafter, referred to as a "second group of heating elements). Accordingly, it is necessary to improve a cooling performance of the first group of heating elements 61 which have a high exothermic values in order to allow a smooth operation of the induction heater 30. Of course, it is also necessary to smoothly cool the second group of heating elements 62 which have a low exothermic values.

Hereinafter, a cooling structure for improving a cooling performance of heating elements will be described.

Figure 4:
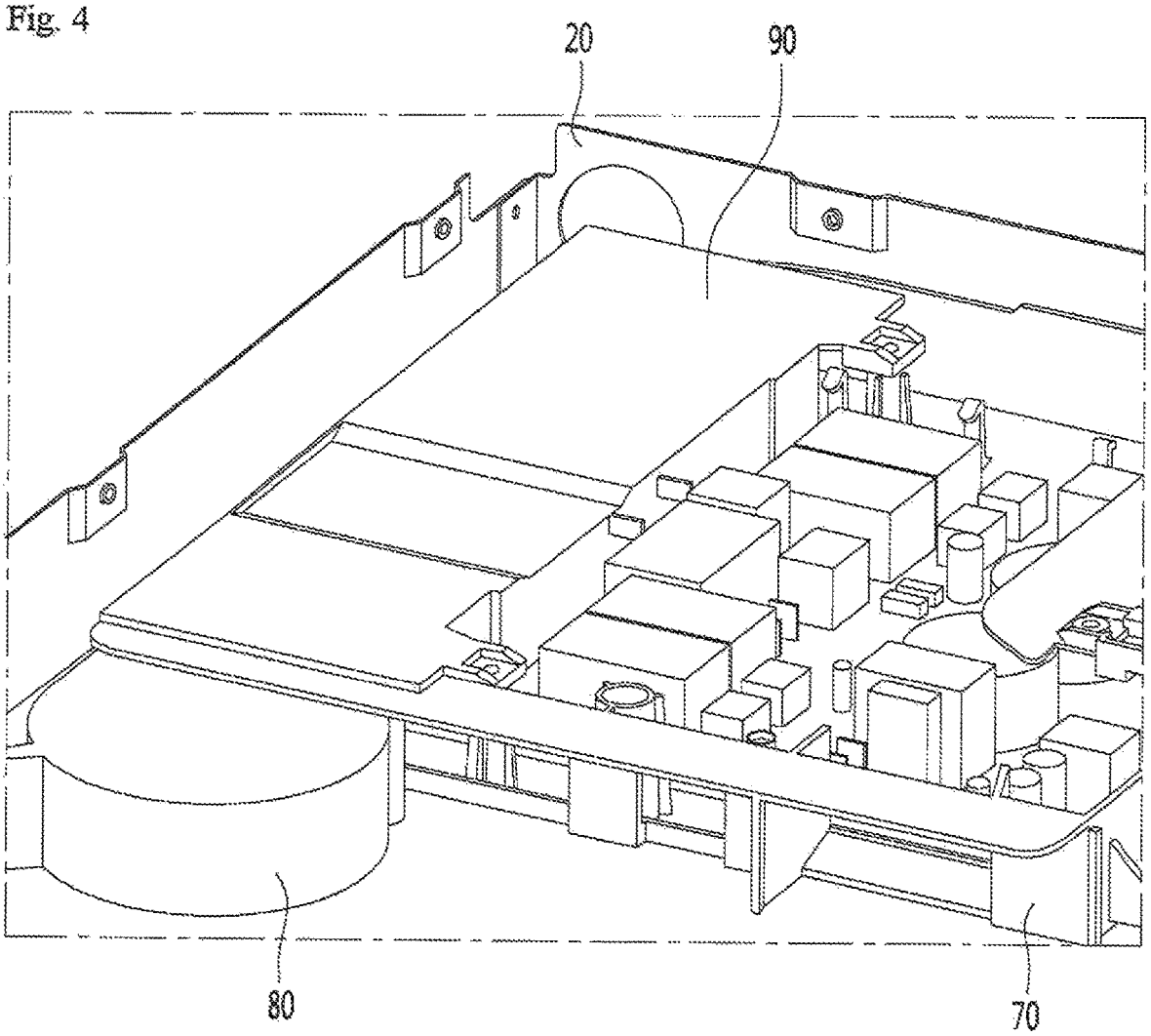
FIG. 4 is a view illustrating a state in which a top plate and a heating coil are removed from the induction heat cooking apparatus of FIG. 1.
Figure 5:
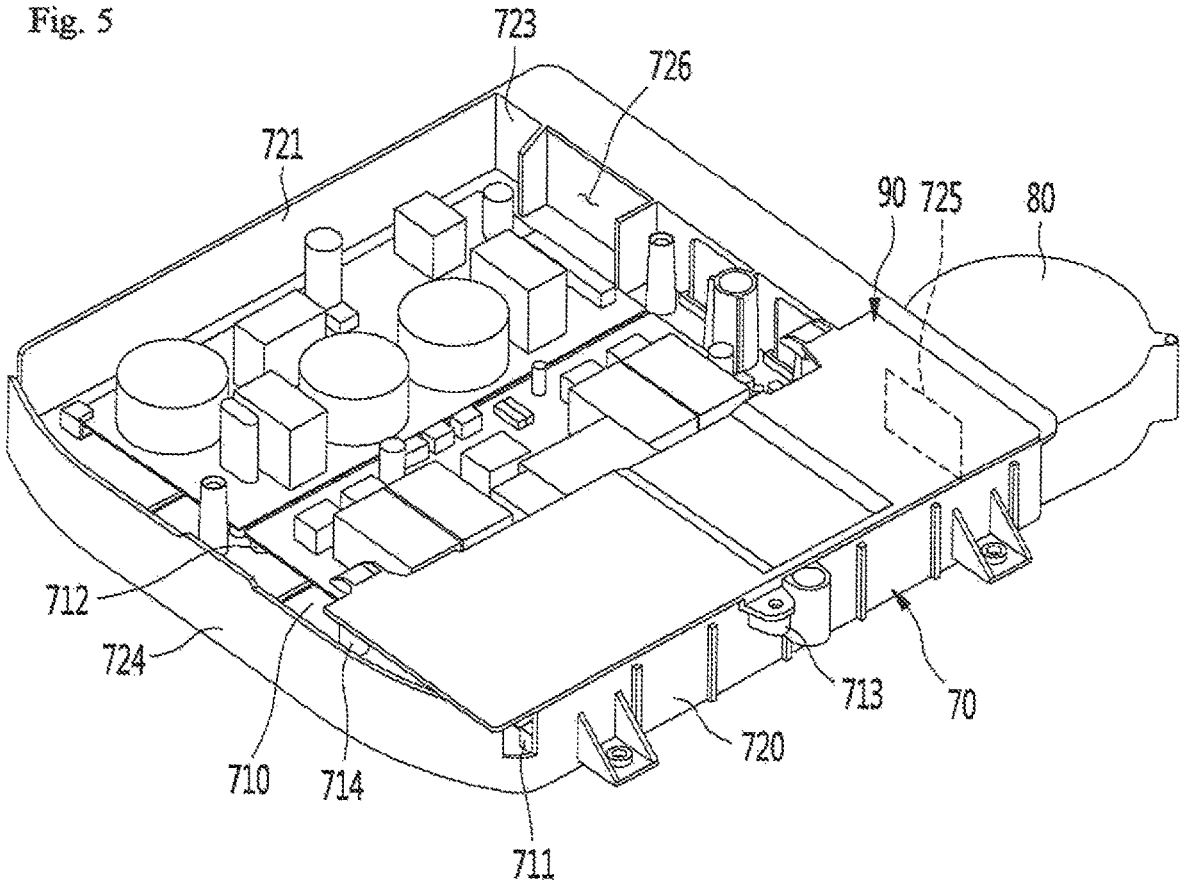
FIG. 5 is a view illustrating a state in which a cooling fan is connected to a housing that accommodates heating elements according to an embodiment.
Figure 6:
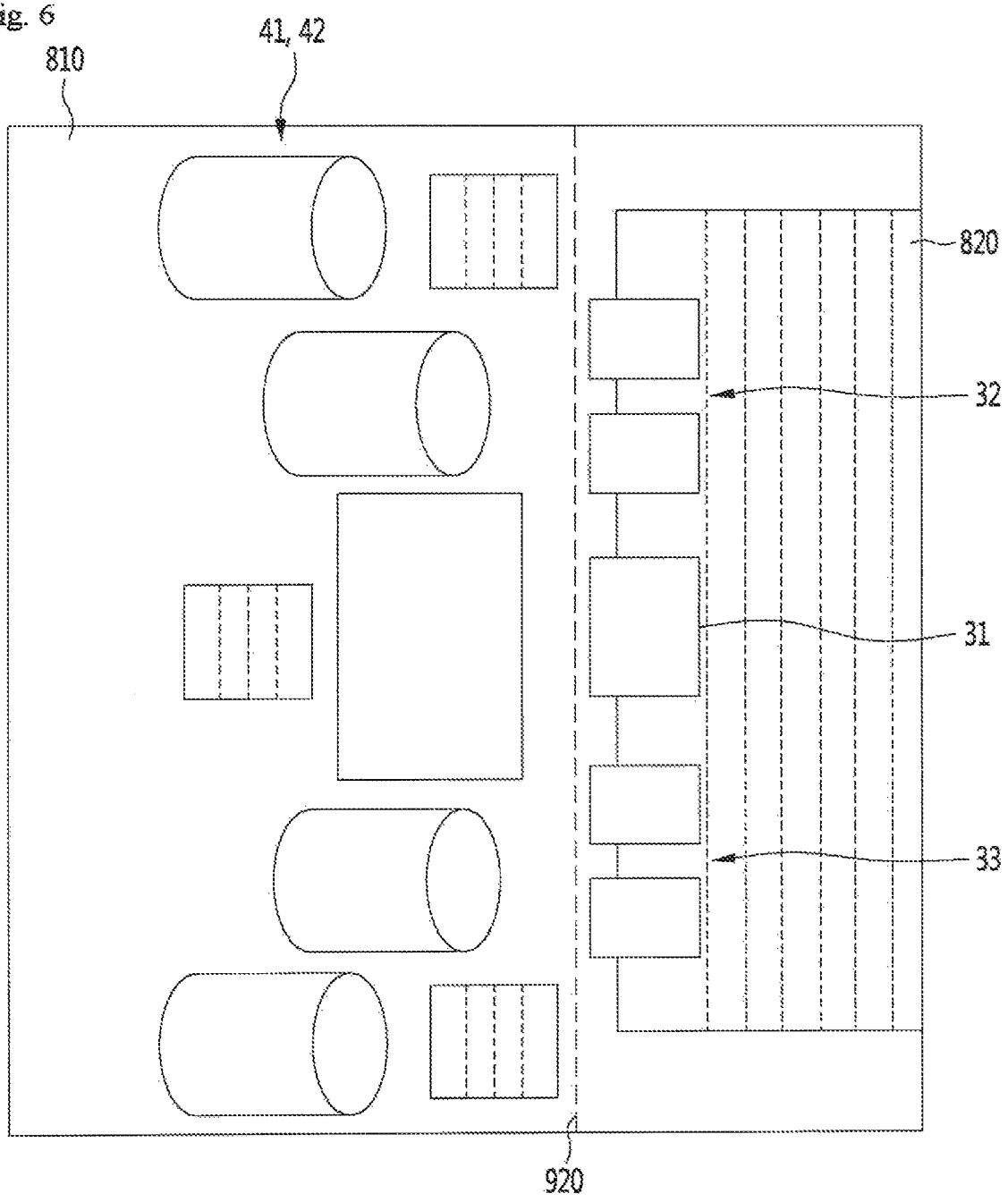
FIG. 6 is a view illustrating an exothermic member and heating elements arranged on a printed circuit board (PCB) according to an embodiment.
Figure 7:
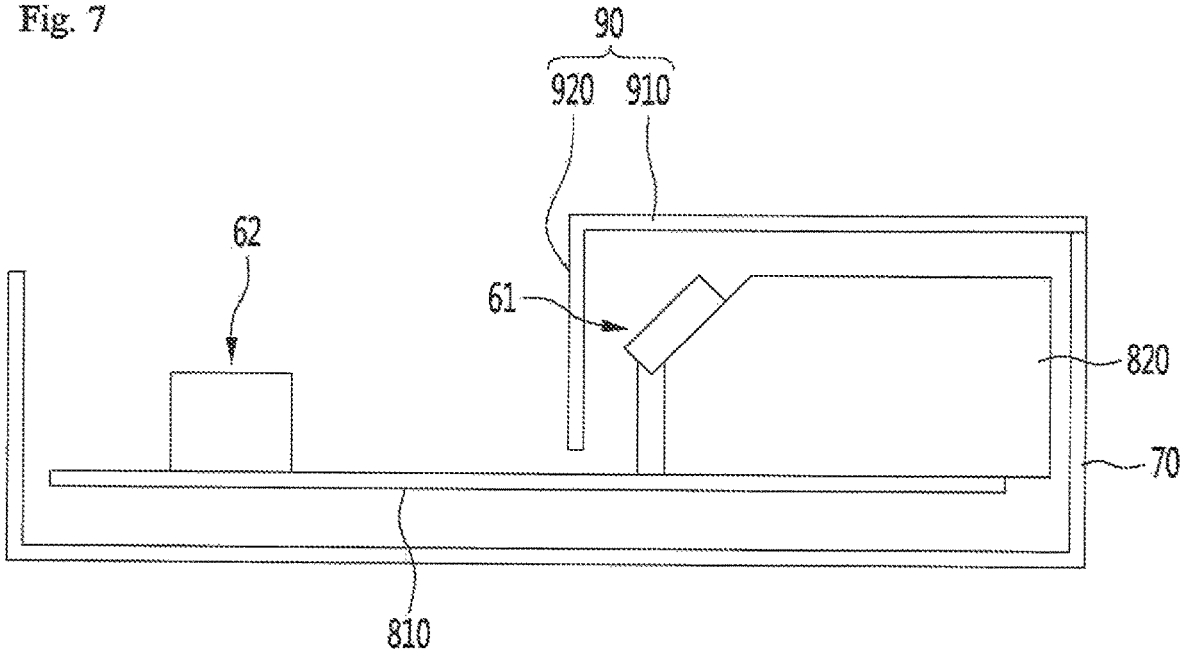
FIG. 7 is a view illustrating a division of positions of the heating elements by a flow guide in the housing according to an embodiment.

FIG. 4 is a view illustrating a state in which a top plate and a heating coil are removed from the induction heat cooking apparatus 1 of FIG. 1. FIG. 5 is a view illustrating a state in which a cooling fan is connected to a housing that accommodates heating elements according to an embodiment. FIG. 6 is a view illustrating an exothermic member and heating elements arranged on a printed circuit board (PCB) according to an embodiment. FIG. 7 is a view illustrating a division of positions of the heating elements by a flow guide in the housing according to an embodiment.

Referring to FIGS. 4 to 7, the induction heat cooking apparatus 1 may include the housing 70 that accommodates heating elements and a cooling fan 80 that blows air for cooling toward the housing 70. The housing 70 may include a bottom surface 710 and sidewalls 720 and 721. The bottom surface 710 of the housing 70 may be mounted on the casing 20. Also, the coil installation 50 at which the heating coils 51, 52, 53, and 54 may be installed or provided may be, for example, combined with the sidewalls 720 and 721 of the housing 70.

The housing 70 may further include a first wall 723, to which the cooling fan 80 may be connected, and a second wall 724 disposed or provided opposite to the first wall 723. The first wall 723 may connect one or a first end of the sidewalls 720 and 721, and the second wall 724 may connect the other or a second end of the sidewalls 720 and 721. Accordingly, the housing 70 may be formed in a shape of a box with an open top.

The first wall 723 may include an air inlet 725, through which air of the cooling fan 80 may be suctioned, and an air outlet 726, through which air which has cooled the heating elements may be discharged. The air inlet 725 and the air outlet 726 may be arranged to be horizontally spaced apart on the first wall 723.

A PCB 810 to which the heating elements may be electrically connected may be installed or provided in the housing 70. Bosses 711 and 712 for installing the PCB 810 may be provided at the bottom surface 710 of the housing 70. The bosses 711 and 712 may protrude upward from the bottom surface 710.

Fastening members, such as screws, that pass through the PCB 810, may be fastened to the bosses 711 and 712. The fastening members may fix the PCB 810 to the bosses 711 and 712 when a portion of the PCB 810 is inserted into the bosses 711 and 712.

The PCB 810 may be spaced apart from the bottom surface 710 of the housing 70 when the PCB 810 is combined with the bosses 711 and 712. The PCB 810 may be separated from the second wall 724 of the housing 70 when the PCB 810 is combined with the bosses 711 and 712. Accordingly, as air suctioned in the housing 70 flows not only above the PCB 810 but also through a space between the PCB 810 and the bottom surface 710 of the housing 70, a cooling performance of heating elements connected to the PCB 810 may be improved.

The induction heat cooking apparatus 1 may further include an exothermic member 820 installed or provided at the PCB 810. The exothermic member 820 may be, for example, a heat sink.

The exothermic member 820 may be positioned between the first wall 723 and the second wall 724 when it is installed or provided at the PCB 810. The exothermic member 820 may be positioned to be adjacent to a first sidewall 720 of the sidewalls 720 and 721 of the housing 70.

The exothermic member 820 may be formed to be long or extend lengthwise in a same direction in which the first sidewall 720 extends. Also, the air inlet 725 may be positioned between the exothermic member 820 and the cooling fan 80. Accordingly, air which is blown by the cooling fan 80 and passes through the air inlet 725 may come into direct contact with the exothermic member 820.

In this embodiment, the first group of heating elements 61 having high exothermic values are installed or provided at the exothermic member 820 to improve a cooling performance of the heating elements having high exothermic values. For example, the rectifier 31 and the inverters 32 and 33 may be installed or provided at the exothermic member 820. Also, the rectifier 31 and the inverters 32 and 33 may be connected to the PCB 810 through wires when the rectifier 31 and the inverters 32 and 33 are installed or provided at the exothermic member 820.

For example, the first group of heating elements 61 may be sequentially arranged in a same direction in which the exothermic member 820 extends. The rectifier 31 may be positioned between the inverters 32 and 33; however, embodiments are not limited thereto.

The second group of heating elements 62 may be directly installed or provided at the PCB 810. For example, the resonance capacitors 41, 42, 43, and 44 may be directly installed or provided at the PCB 810.

The second group of heating elements 62 may be installed or provided on the PCB 810 at a position separated from the exothermic member 820. For example, the second group of heating elements 62 may be installed or provided between a second sidewall 721 of the sidewalls 720 and 721 of the housing 70 and the exothermic member 820 when the exothermic member 820 is installed or provided at the PCB 810.

The induction heat cooking apparatus 1 may further include a flow guide 90 that guides air blown from the cooling fan 80 toward the second wall 724 of the housing 70 to focus the air blown from the cooling fan 80 on the first group of heating elements 61. The flow guide 90 may be combined with the housing 70. The housing 70 may include a plurality of guide combiners 713 and 714. One or a first guide combiner 713 of the plurality of guide combiners 713 and 714 may be provided on the first sidewall 720 of the housing 70 and the other or a second guide combiner 714 may protrude upward from the bottom surface 710 of the housing 70.

The flow guide 90 may include a cover plate 910 that prevents air which passes through the air inlet 725 from being discharged above the housing 70 and prevents heat of the heating coils 51, 52, 53, and 54 from being transferred to the exothermic member 820. The cover plate 910 may be combined with the plurality of guide combiners 713 and 714. For example, fastening members, such as screws, may pass through the cover plate 910 and be combined with the plurality of guide combiners 713 and 714. The cover plate 910 may cover a top of the exothermic member 820 while being spaced apart from the top of the exothermic member 820.

The flow guide 90 may further include a dividing plate 920 that divides a first cooling flow channel 63 (refer to FIG. 8) of the first group of heating elements 61 from a second cooling flow channel 64 (refer to FIG. 8) of the second group of heating elements 62. The dividing plate 920 may extend downward from one end of the cover plate 910.

The dividing plate 920 may be positioned between the first group of heating elements 61 and the second group of heating elements 62. The dividing plate 920 may guide air suctioned through the air inlet 725 toward the second wall 724 of the housing 70 to intensively cool the first group of heating elements 61 using the air suctioned through the air inlet 725.

A bottom end of the dividing plate 920 may be positioned below a lowermost point of the first group of heating elements 61, which may be installed or provided at the exothermic member 820, to adequately guide the air suctioned through the air inlet 725 toward the second wall 724 of the housing 70. The dividing plate 920 may be in contact with the PCB 810.

A horizontal width of the cover plate 910 (a width in a direction that intersects a flow direction of the air suctioned through the air inlet 725) may be formed to be larger than a horizontal width of the exothermic member 820. Further, horizontal widths of the dividing plate 920 and the first sidewall 720 of the housing 70 may be formed to be larger than the horizontal width of the exothermic member 820. Furthermore, the horizontal width of the exothermic member 820 may be formed to be larger than a horizontal width of the air inlet 725.

The dividing plate 920 may be spaced apart from the second wall 724 of the housing 70 to allow air that cools the first group of heating elements 61 to cool the second group of heating elements 62. Accordingly, air that flows along the dividing plate 920 and cools the first group of heating elements 61 may be changed in direction at an end of the dividing plate 920 while flowing through a space between the end of the dividing plate 920 and the second wall 724 of the housing 70, and then cool the second group of heating elements 62.

As described above, the second wall 724 of the housing 70 may change a flow direction of the air which has cooled the first group of heating elements 61. Accordingly, the second wall 724 may be formed to be rounded to smoothly change the flow direction of the air. In this embodiment, the second wall 724 of the housing 70 may be referred to as a "guide wall". For example, the second wall 724 may be rounded to be convex in a direction away from the first wall 723.

Figure 8:
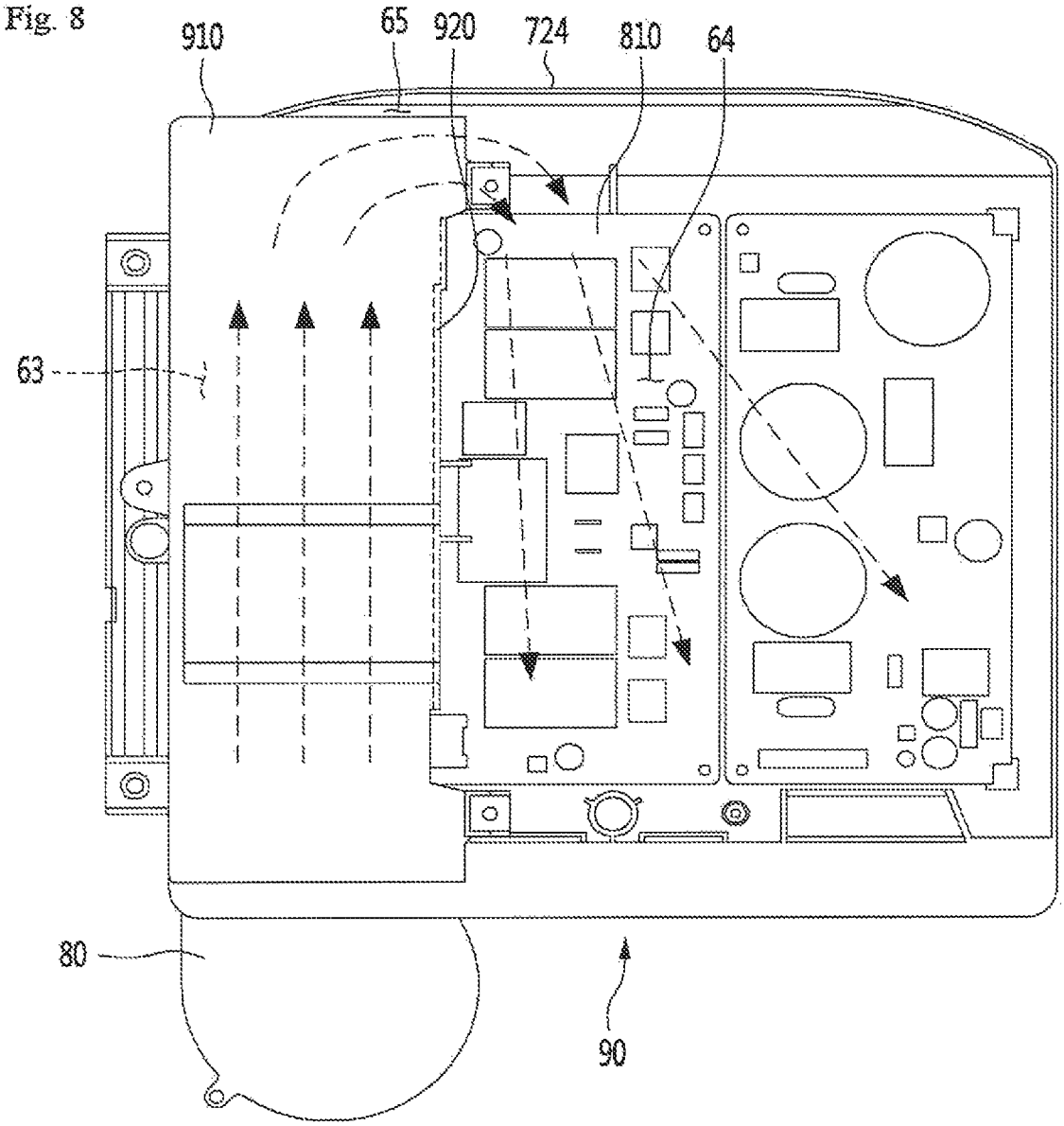
FIG. 8 is a view illustrating an airflow for cooling the heating elements in the housing according to an embodiment.

FIG. 8 is a view illustrating an airflow for cooling the heating elements in the housing according to an embodiment. Referring to FIGS. 1 to 8, the dividing plate 920 may extend between the first wall 723 and the second wall 724 of the housing 70 in a direction that intersects the first wall 723 and the second wall 724 and divides the first cooling flow channel 63 from the second cooling flow channel 64. Accordingly, the first cooling flow channel 63 may be positioned at one or a first side of the dividing plate 920 and the second cooling flow channel 64 may be positioned at the other or a second side thereof.

When the cooling fan 80 is operated, air may be suctioned into the housing 70 by the cooling fan 80 through the air inlet 725. Air for cooling may be suctioned into the first cooling flow channel 63 between the first sidewall 720 of the housing 70 and the dividing plate 920 through the air inlet 725. The air for cooling suctioned into the first cooling flow channel 63 may flow through the first cooling flow channel 63 and intensively cools the first group of heating elements 61 installed or provided at the exothermic member 820.

Air which has flowed through the first cooling flow channel 63 may be changed in direction while flowing through a connection flow channel 65 between the end of the dividing plate 920 and the second wall 724 of the housing 70, and then cool the second group of heating elements 62 while flowing through the second cooling flow channel 64. Air which has cooled the second group of heating elements 62 may be discharged from the housing 70 through the air outlet 726.

According to this embodiment, as the first group of heating elements having high exothermic values are intensively cooled by air and then the second group of heating elements having low exothermic values are cooled, a cooling performance of heating elements may be improved. Further, as the connection flow channel is formed by the rounded guide wall, a flow loss caused by a flow direction being changed may be reduced. Furthermore, as the air inlet and the air outlet are formed at the first wall, cooling of the second group of heating elements positioned at the second cooling flow channel may be adequately performed.

Embodiments disclosed herein may be embodied in an induction heat cooking apparatus capable of intensively cooling elements having high exothermic temperatures among elements for operating coils. Embodiments disclosed herein may further be embodied in an induction heat cooking apparatus in which air which has cooled elements having high exothermic temperatures may cool other heating elements.

Accordingly, an induction heating cooking apparatus according to embodiments may include heating coils and a plurality of heating elements that operates the heating coils. To smoothly cool the plurality of heating elements, the induction heat cooking apparatus may include a housing that accommodates the plurality of heating elements, a cooling fan that blows air that cools the plurality of heating elements accommodated in the housing toward the housing, a first cooling flow channel in which the first group of heating elements of the plurality of heating elements may be positioned, a second cooling flow channel in which a second group of heating elements having exothermic values lower than exothermic values of the first group of heating elements are positioned, and a flow guide that divides the first cooling flow channel from the second cooling flow channel and guides a flow of the air blown by the cooling fan to allow the air to flow to the first cooling flow channel first and then flow to the second cooling flow channel. The housing may include a first wall having an air inlet through which the air blown by the cooling fan may be suctioned and a second wall positioned opposite the first wall.

The flow guide may guide the air suctioned through the air inlet to allow the air to flow toward the second wall through the flow guide. The flow guide may include a dividing plate that divides the first cooling flow channels from the second cooling flow channel. The dividing plate may extend between the first wall and the second wall in a direction intersecting the first wall and the second wall.

The first cooling flow channel may be disposed or provided at one or a first side of the dividing plate, and the second cooling flow channel may be disposed or provided at the other or a second side of the dividing plate. An end of the dividing plate may be spaced apart from the second wall to allow air which has flowed through the first cooling flow channel to flow to the second cooling flow channel.

The second wall may be rounded to be convex in a direction away from the first wall to smoothly change a flow direction of the air. An air outlet through which air flowing through the second cooling flow channel may be discharged may be provided at the first wall to allow the air to adequately cool the second group of heating elements of the second cooling flow channel.

The induction heat cooking apparatus may further include an exothermic member at which the first group of heating elements may be installed or provided and a printed circuit board (PCB) at which the second group of heating elements may be installed or provided. The PCB may be installed or provided in the housing while being spaced apart from a bottom surface of the housing.

A bottom end of the dividing plate may be positioned to be lower than a lowermost point of the first group of heating elements installed or provided at the exothermic member. The bottom end of the dividing plate may come into contact with the PCB.

The flow guide may further include a cover plate that covers a top of the exothermic member.

Although the technical concept has been exemplarily described above, various modifications may be made by one of ordinary skill in the art without departing from the essential features. Accordingly, the above-described implementation examples are not intended to limit the technical concept but to explain the same. The scope of the technical concept is not limited thereto. It should be appreciated that the scope should be defined by the claims and equivalents thereof should be included in the scope.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An induction heat cooking module, comprising a housing having a first sidewall and a second sidewall facing the first sidewall;

a plurality of heating coils supported by the first sidewall and the second sidewall and provided at a top of the housing;

a first group of heating elements including a rectifier and inverters provided below the plurality of heating coils, arranged closer to the first sidewall than the second sidewall, and having a relatively high exothermic values among a plurality of heating elements;

a second group of heating elements including resonance capacitors provided below the plurality of heating coils, arranged closer to the second sidewall than the first sidewall, and having a relatively low exothermic values among the plurality of heating elements;

an air inlet provided close to the first sidewall between ends of the first sidewall and the second sidewall and through which air for cooling the first group of heating elements is suctioned;

a guide wall that guides air which has flowed through a space in which the first group of heating elements is arranged to a space in which the second group of heating elements is arranged; and an air outlet provided close to the second sidewall between the ends of the first sidewall and the second sidewall and through which air which has cooled the second group of heating elements is discharged.

2. The induction heat cooking module of claim 1, wherein the space in which the first group of heating elements is arranged and the space in which the second group of heating elements is arranged is divided by a dividing plate that extends in a direction parallel to a flow direction of the air.

3. The induction heat cooking module of claim 2, wherein an end of the dividing plate is spaced apart from the guide wall.

4. The induction heat cooking module of claim 2, further including:

an exothermic member at which the first group of heating elements is provided; and a printed circuit board (PCB) at which the second group of heating elements is provided.

5. The induction heat cooking module of claim 4, wherein a bottom end of the dividing plate is positioned to be lower than a lowermost point of the first group of heating elements provided at the exothermic member.

6. The induction heat cooking module of claim 5, wherein the bottom end of the dividing plate is in contact with the PCB.

7. The induction heat cooking module of claim 4, wherein the exothermic member extends parallel to a flow direction of the air.

8. The induction heat cooking module of claim 1, further including a cover plate that divides the space in which the first group of heating elements is arranged and a space at which the plurality of heating coils is provided.

9. The induction heat cooking module of claim 1, wherein the guide wall is rounded to be convex.

10. The induction heat cooking module of claim 1, further comprising a first cooling flow channel in which the first group of heating elements is positioned; and a second cooling flow channel in which the second group of heating elements is positioned.

11. The induction heat cooking module of claim 1, wherein the housing further includes a first wall having the air inlet, and wherein the guide wall is positioned opposite the first wall.

12. The induction heat cooking module of claim 11, and wherein the flow guide guides the air suctioned through the air inlet to allow the air to flow toward the guide wall through the flow guide.

13. The induction heat cooking module of claim 1, further including a cover plate that divides the space in which the first group of heating elements is arranged and a space at which the plurality of heating coils is provided.

* * * * *